US007824155B2

(12) United States Patent
Chen

(10) Patent No.: US 7,824,155 B2
(45) Date of Patent: Nov. 2, 2010

(54) FAN HOLDER

(75) Inventor: Wen-Hua Chen, Taipei (TW)

(73) Assignee: Inventec Corporation, Taipei (TW)

( * ) Notice: Subject to any disclaimer, the term of this patent is extended or adjusted under 35 U.S.C. 154(b) by 869 days.

(21) Appl. No.: 11/785,198

(22) Filed: Apr. 16, 2007

(65) Prior Publication Data

US 2008/0253886 A1 Oct. 16, 2008

(51) Int. Cl.
*F04D 29/64* (2006.01)

(52) U.S. Cl. ..... 415/213.1; 361/695

(58) Field of Classification Search ..... 415/213.1, 415/214.1, 232, 220; 416/244 R, 247 R
See application file for complete search history.

(56) References Cited

U.S. PATENT DOCUMENTS 6,587,342 B1 7/2003 Hsu

2003/0039546 A1* 2/2003 Liu ..... 415/213.1

* cited by examiner

*Primary Examiner*—Richard Edgar
(74) *Attorney, Agent, or Firm*—Muncy, Geissler, Olds & Lowe, PLLC

(57) ABSTRACT

A fan holder is provided for holding a fan on a base, wherein the fan holder includes a fixed frame, a movable frame, and a lid. The fixed frame is fixed on the base while the movable frame is pivotally connected to the base, and the movable frame is spaced from the fixed frame by an interval. When the movable frame rotates relative to the base, a containing space is formed between the fixed frame and the movable frame to accommodate the fan. The lid is pivotally connected to an upper edge of the fixed frame, so as to be swiveled relative to the fixed frame for covering the fan, and the lid is engaged with the movable frame simultaneously, so as to holding the fan in the containing space.

6 Claims, 3 Drawing Sheets

FAN HOLDER

BACKGROUND OF THE INVENTION

1. Field of Invention

The present invention relates to a fan holder, and more particularly, to a tool-less fan holder.

2. Related Art

Fans are required in a computer, for generating cooling airflow to dissipate the heat generated by electronic components of the computer.

The conventional approach for fixing a fan is fixing the fan on a case of a computer with a plurality of screws or other screwing members. As for a computer system only equipped with one or two fans, such an approach may satisfy the requirement for fixing fans. However, as for a large-scale computer system, such as a server, multiple fans are required to be assembled, and each fan has to be fixed by several screws. Such an approach is time consuming to deal with the screws, and a tool, such as a screw driver, is required to deal with the screws.

In order to save the time of using a tool to deal with the screws, many tool-less fan holders have been provided. For example, in U.S. Pat. No. 6,587,342, a snap coupling device is provided to replace the screws or the screwing members, so as to achieve quick assembly/disassembly of the fan.

However, no matter a fan is fixed in a fan holder by means of snap coupling or the fan holder is fixed to the case by means of snap coupling, the following defects still exist. The latches of the fan holder are engaged into the case of the computer or engaged with the fan through elastic deformation. When the rigidity of the latch is relative high, the snap coupling force will be increased, but the fan or the holder is getting harder to be disassembled and even the latch might be broken or damaged during the disassembly. When the rigidity of the latch is relative low, the snap coupling force is insufficient, with a result that the fan and the fan holder may easily jiggle and even fall off. Therefore, it has become an issue to be solved on how to hold the fan securely and meanwhile make the fan holder easy to be operated.

SUMMARY OF THE INVENTION

In view of the above problems, the object of the present invention is to provide a fan holder, with which a fan can be fixed or removed rapidly without use of tools.

In order to achieve the object of the present invention, a fan holder of the present invention is provided for holding a fan on a base. The fan holder includes a fixed frame, a movable frame, and a lid. The fixed frame is fixed on the base. The movable frame has a first engaged side and a first pivoted side opposite to each other, and the first pivoted side is pivotally connected to the base, such that the movable frame is spaced from the fixed frame by an interval. When the movable frame is swiveled relative to the base, a containing space is formed between the fixed frame and the movable frame. The lid has a second engaged side and a second pivoted side opposite to each other. The second pivoted side of the lid is pivotally connected to an upper edge of the fixed frame, and the second engaged side is engaged with the first engaged side of the movable frame to fix the movable frame, so as to hold the fan in the containing space.

In the present invention, the fan is securely held in the containing space surrounded by the fixed frame, the movable frame, the lid, and the base, and the structure thereof is simple. Meanwhile, the lid and the movable frame are joined by means of engagement, which can be done rapidly without any tool. In addition, the movable frame and the lid both can be unfolded away from the containing space, which is convenient for putting in or taking out the fan instead of doing the same with a narrow enclosed space.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The objectives, structures, features, and functions of the present invention will be illustrated in detail below accompanied with the embodiments.

Figure 1:
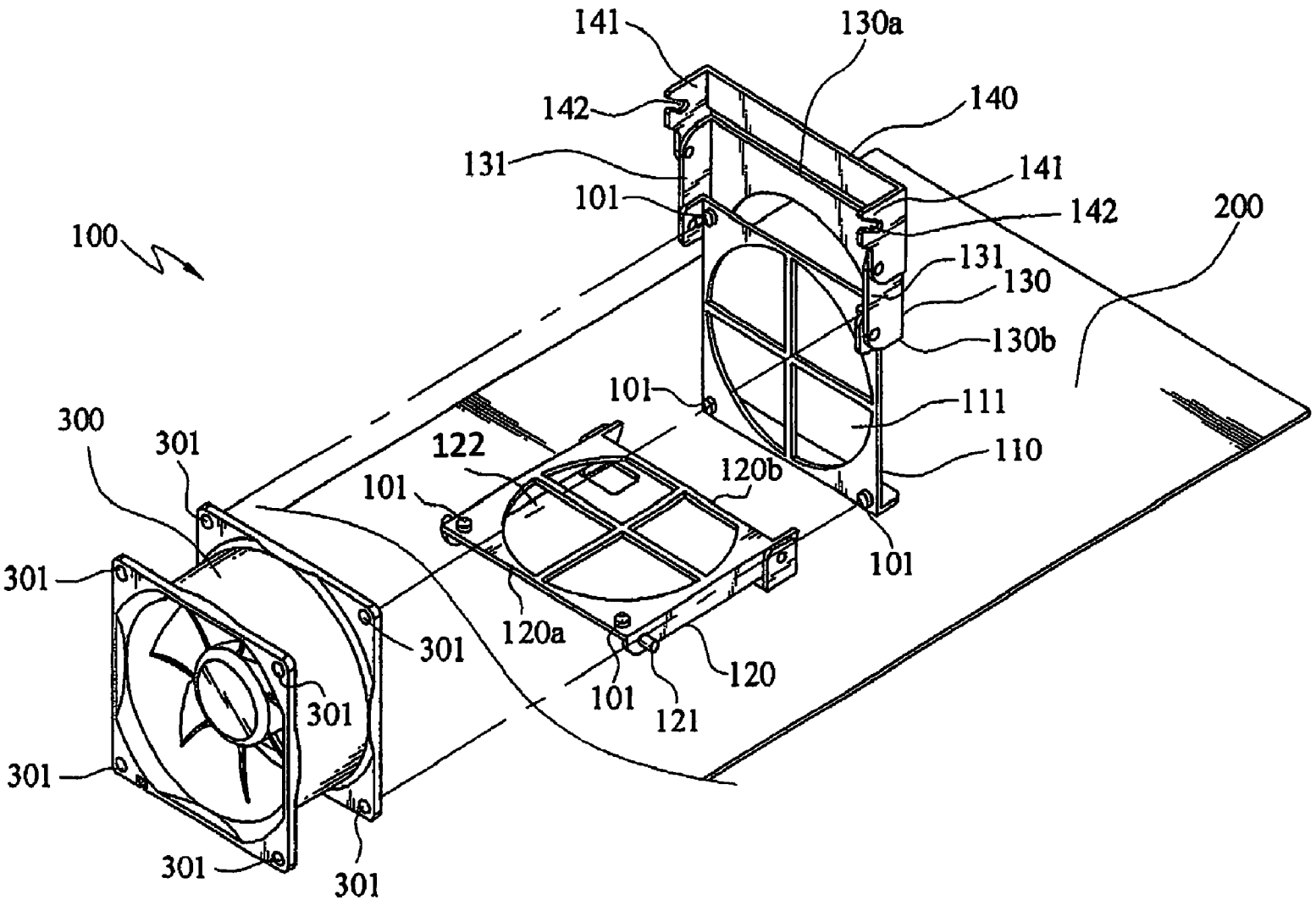
FIG. 1 is a perspective view of an embodiment of the present invention, showing a state in which the fan is not fixed to the fan holder.
Figure 2:
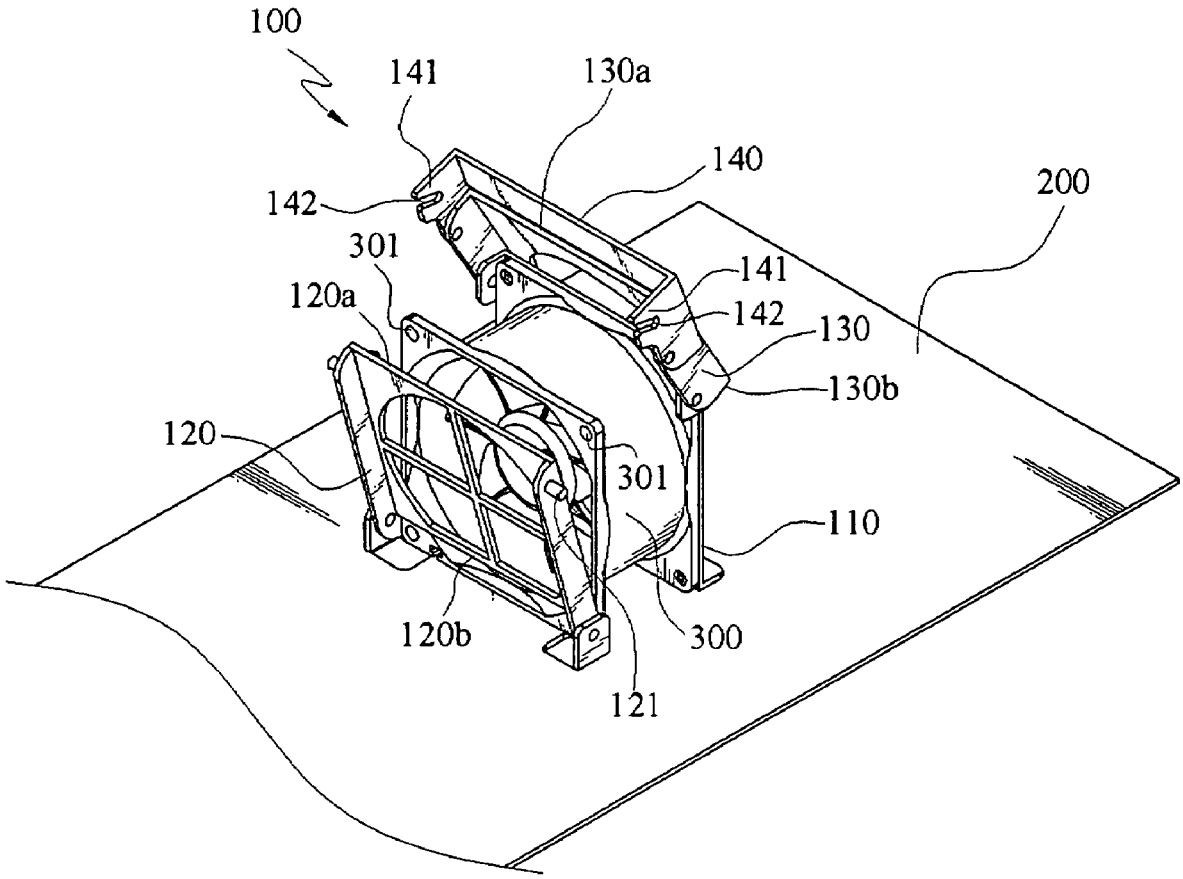
FIG. 2 is a perspective view of an embodiment of the present invention, showing a state in which the fan is placed in the fan holder.

Referring to FIGS. 1 and 2, a fan holder 100 according to an embodiment of the present invention is shown. The fan holder 100 is disposed on a base 200 for holding a fan 300 on the base 200. The base 200 may be a part of a computer case or a structural member disposed inside the case.

Referring to FIGS. 1 and 2, the fan holder 100 includes a fixed frame 110, a movable frame 120, and a lid 130. A containing space for holding the fan 300 and fixing the fan 300 on the base 200 is defined by the base 200, the fixed frame 110, the movable frame 120, and the lid 130.

The fixed frame 110 is fixed on and perpendicular to the base 200. The fixed frame 110 has an opening 111 for airflow to pass through, and the opening 111 is shielded by a protecting mesh to prevent foreign substance from passing through.

The movable frame 120 has a first engaged side 120*a* and a first pivoted side 120*b* opposite to each other. The first pivoted side 120*b* is pivoted to the base 200, such that the movable frame 120 is spaced from the fixed frame 110 by an interval. The interval is similar to or slightly larger than the thickness of the fan 300, such that the fan 300 can be exactly seized by the fixed frame 110 and the movable frame 120 from the front and the back. When the movable frame 120 is swiveled relative to the base 200 to be perpendicular to the base 200, a containing space is formed between the fixed frame 110 and the movable frame 120 for containing the fan 300. The movable frame 120 also has an opening 122 for airflow to pass through, and the opening 122 is also shielded by a protecting mesh to prevent foreign substance from passing through. In order to keep the fan 300 from sliding in a direction parallel to the fixed frame 110 and the movable frame 120, the fan holder 100 further includes a plurality of fixing pillars 101, which is disposed on an inner side surface of the fixed frame 110 and an inner side surface of the movable frame 120, so as to be inserted into fixing holes 301 in the front side surface and rear side surface of the fan 300, for fixing the fan 300. A buffer material is attached around the fixing holes 301 of the fan 300 to absorb the vibration generated when the fan 300 works and to prevent the vibration from reaching the base 200 or the members disposed in the case of the computer through the fixed frame 110 or the movable frame 120.

Figure 3:
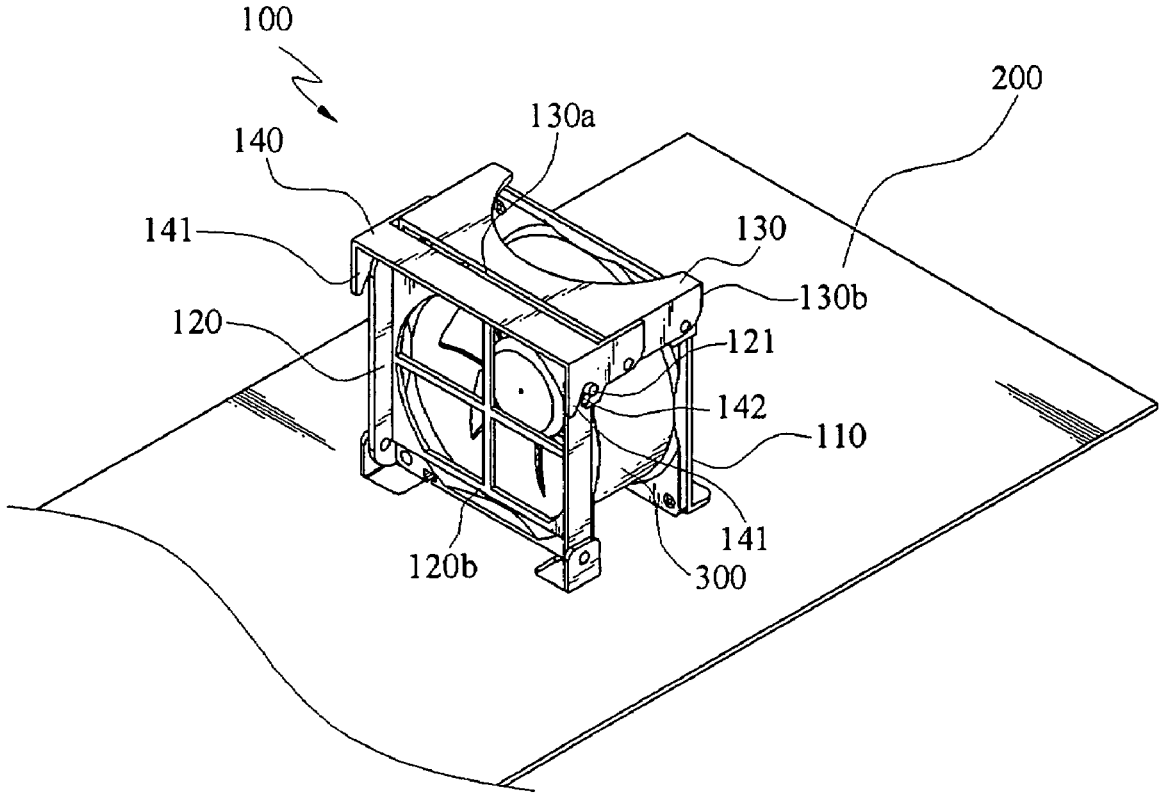
FIG. 3 is a perspective view of an embodiment of the present invention, showing a state in which the fan is held to the fan holder.

As shown in FIGS. 1, 2, and 3, the lid 130 is mainly used to press the fan 300 from the top and fix the movable frame 120. The lid 130 has a second engaged side 130*a* and a second pivoted side 130*b* opposite to each other, and the second pivoted side 130*b* of the lid 130 is pivoted to an upper edge of the fixed frame 110, such that the lid 130 can be swiveled relative to the fixed frame 110 to cover the fan 300.

The second engaged side 130*a* of the lid 130 is engaged with the first engaged side 120*a* of the movable frame 120. The fan holder 100 further includes a rotatable engaged member 140 which is pivotally connected to the second engaged side 130*a* of the lid 130 and can be swiveled relative to the lid 130. Furthermore, the rotatable engaged member 140 has two extending lugs 141 corresponding to the two opposite sides of the lid 130, and a catching slot 142 is formed in each of the lugs 141. The movable frame 120 has two caught pins 121 disposed on the first engaged side 120*a* corresponding to the two opposite sides of the movable frame 120 and extending outwards. Thus, when the lid 130 rotates relative to a fixed side to make the second engaged side 130*a* of the lid 130 face the first engaged side 120*a* of the movable frame 120, the caught pins 121 of the movable frame 120 are slid into the corresponding catching slot 142 respectively to make the rotatable engaged member 140 engaged with the first engaged side 120*a*, such that the fan 300 is accommodated and held in the containing space formed by connecting the fixed frame 110, the movable frame 120, the lid 130, and the base 200.

Furthermore, the lid 130 further has two raised edges 131 formed on the two opposite sides of the lid 130. The two raised edges 131 press against on the outside edges of the fan 300 when the lid 130 is engaged with the movable frame 120, so as to prevent the fan 300 from moving relative to the fixed frame 110 and the movable frame 120.

In the present invention, the fan 300 is securely held in the containing space formed by the fixed frame 110, the movable frame 120, the lid 130, and the base 200, and the structure thereof is simple. Meanwhile, the lid 130 and the movable frame 120 are joined by means of engagement instead of using screws or other fixing members, and can be joined rapidly without use of tools. In addition, the movable frame 120 and the lid 130 both can be unfolded away from the containing space, such that the containing space becomes an open area which is convenient for putting in or taking out the fan 300 instead of doing the same with a narrow enclosed space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fan holder, for holding a fan on a base, comprising:

a fixed frame, fixed on the base;

a movable frame, having a first engaged side and a first pivoted side opposite to each other, wherein the first pivoted side is pivotally connected to the base, such that the movable frame is spaced from the fixed frame by an interval, and a containing space between the fixed frame and the movable frame is formed when the movable frame is swiveled relative to the base to accommodate the fan; and a lid, having a second engaged side and a second pivoted side opposite to each other, wherein the second pivoted side of the lid is pivotally connected to an upper edge of the fixed frame, and the second engaged side of the lid is provided for being engaged with the first engaged side of the movable frame, so as to hold the fan in the containing space.

2. The fan holder as claimed in claim 1, further comprising a plurality of fixing pillars disposed on an inner side surface of the fixed frame and inserted into the fan.

3. The fan holder as claimed in claim 1, further comprising a plurality of fixing pillars disposed on an inner side surface of the movable frame and inserted into the fan.

4. The fan holder as claimed in claim 1, further comprising a rotatable engaged member pivotally connected to the second engaged side of the lid for being engaged with the first engaged side of the movable frame.

5. The fan holder as claimed in claim 4, wherein the rotatable engaged member has at least one catching slot, and the movable frame has at least one caught pin disposed at the first engaged side to be slid into the catching slot, such that the rotatable engaged member is engaged with the first engaged side of the movable frame.

6. The fan holder as claimed in claim 1, wherein the lid has two raised edges formed on the two opposite sides of the lid, for pressing against the outside edges of the fan, so as to prevent the fan from moving relative to the fixed frame and the movable frame.

* * * * *